US007302986B2

(12) United States Patent
Flack, II et al.

(10) Patent No.: US 7,302,986 B2
(45) Date of Patent: Dec. 4, 2007

(54) COMBINATION SECURITY AND INSECT GUARD INSERT

(75) Inventors: Harold E. Flack, II, Dallas, PA (US); Robert Manzella, Harvey's Lake, PA (US); Jay Kush, Swoyersville, PA (US)

(73) Assignee: Exeter Architectural Products, Wyoming, PA (US)

( * ) Notice: Subject to any disclaimer, the term of this patent is extended or adjusted under 35 U.S.C. 154(b) by 364 days.

(21) Appl. No.: 10/905,081

(22) Filed: Dec. 14, 2004

(65) Prior Publication Data

US 2006/0124255 A1 Jun. 15, 2006

(51) Int. Cl.
*A47G 5/00* (2006.01)

(52) U.S. Cl. ..... 160/89; 160/371; 160/179

(58) Field of Classification Search ..... 160/179, 160/371, 89, 104, 369, 368.1
See application file for complete search history.

(56) References Cited

U.S. PATENT DOCUMENTS 1,487,335 A * 3/1924 Jaeger ..... 160/381
1,703,355 A 2/1929 Nielsen
1,764,913 A 6/1930 Vande Mark
1,902,949 A 3/1933 Condon
2,335,361 A 11/1943 Schiller
2,784,781 A 3/1957 Rhoades
2,800,956 A 6/1957 Xanten
3,053,566 A * 9/1962 Allen ..... 296/106
3,143,165 A * 8/1964 Lewis et al. ..... 160/394
3,363,390 A * 1/1968 Crane et al. ..... 52/716.8
3,455,367 A 7/1969 Le Tarte
3,552,476 A 1/1971 Le Tarte
3,696,857 A 10/1972 Le Tarte
3,871,434 A * 3/1975 Hance ..... 160/91
3,960,197 A 6/1976 Daniels
4,127,156 A * 11/1978 Brandt ..... 160/179
4,232,310 A * 11/1980 Wilson ..... 340/550
4,333,284 A 6/1982 Meadows
5,056,262 A 10/1991 Schweiss et al.
5,141,046 A * 8/1992 Duncan ..... 160/379
5,620,036 A 4/1997 Grous
5,832,666 A 11/1998 Flack, II et al.
6,125,910 A * 10/2000 Pepperell et al. ..... 160/371
6,378,267 B1 4/2002 Bass

OTHER PUBLICATIONS

Exeter Architecural Products, Security Shield Window Barriers, Sales Literature, Copyright 2003.

* cited by examiner

*Primary Examiner*—Blair M. Johnson
(74) *Attorney, Agent, or Firm*—Mitchell A. Smolow

(57) ABSTRACT

The present invention comprises an insect screen and a security barrier contained within a removable frame installable to replace a conventional screen or storm window, the assembly functioning both as a barrier to insect penetration, and as a security barrier to deter an intruder from entering the building through the window or door. The main components of the window guard insert comprise a frame assembly, a security barrier, an insect screen, a spline, and a weather strip. The assembled frame includes a security barrier channel to retain the security barrier, a weather strip channel to retain the weather strip and an insect screen channel, partially formed by the security barrier to retain the insect screen. An optional clip retaining channel is used to increase the window guard insert's ability to withstand an unauthorized entry attempt.

19 Claims, 4 Drawing Sheets

COMBINATION SECURITY AND INSECT GUARD INSERT

FIELD OF THE INVENTION

This invention relates generally to door and window guard inserts, and more particularly to a removable door and window guard insert adapted to function both as a security barrier and as an insect barrier to deter both intruders and insects from entering the building through the door or window.

BACKGROUND OF THE INVENTION

Fine mesh screen is commonly used in door and window openings to prevent insects from gaining interior access. While effective at insect control, fine mesh screen is easily cut, making it ineffective as a security device. Building windows, especially those on a ground floor level, are commonly protected from unauthorized entry by means of window guards or grills. Often a guard formed by a framed mesh screen of heavy gauge wire or heavy gauge perforated metal is used to make it difficult for an intruder to enter.

While heavy gauge mesh or perforated metal is adequate for security purposes, it is not used to simultaneously inhibit insects, for reducing the mesh opening or perforations to a size that would inhibit insects would prohibitively restrict visibility. With both heavy gauge wire mesh screen sized to prevent insect penetration and perforated metal screen manufactured with small diameter perforations sized to prevent insect penetration there is a marked reduction in the amount of admitted light and air. Visibility is hindered by the small grid size of the screen or the small diameter perforations, particularly when looking through the guarded window at an oblique angle.

One method used to overcome the visibility limitation is to combine into one window guard two separate screens—a fine mesh screen for insect control and a perforated metal screen for security. Perforated metal screens fabricated from a single sheet of relatively thin metal perforated in a predetermined pattern to admit light and ventilating air are available. The perforated pattern is aesthetically pleasing to render the installation attractive while also providing adequate security and maintaining good visibility.

Such a combination is currently being manufactured in a permanently mounted window guard by the assignee of the present invention. However, this permanently mounted combination security perforated panel and fine mesh screen is limited in its application due to its relative high manufacturing and installation costs.

A permanently mounted window guard has a number of other disadvantages. For example, in the event of a fire or other emergency, it is not possible to leave the building through the guarded window.

Still another disadvantage to permanently mounted guards is that window guards are subjected to weathering; in time it may be necessary to replace the fine mesh screen or paint the frame. Likewise, exterior window panes require periodic cleaning. With permanently mounted window guards, these parts may be inaccessible or difficult to remove for purposes of maintenance and repair.

Accordingly, there is still a continuing need for improved combination security and insect screens; specifically, window guards that are removably mounted. The present invention fulfills this need and further provides related advantages.

BRIEF SUMMARY OF THE INVENTION

The present invention relates to a security screen—insect screen combination window and door guard insert that is easily installed in window and door openings to replace existing conventional screen or storm window and door inserts, thereby avoiding the need for costly professional installation.

Briefly stated, the present invention comprises a fine mesh screen and a security screen contained within a removable frame installable to replace a conventional screen or storm window, the assembly functioning both as a barrier to insect penetration, and as a security barrier to deter an intruder from entering the building through the window or door.

The main components of the window guard insert comprise a frame assembly, a security barrier, an insect screen, a spline, and a weather strip. The assembled frame includes a security barrier channel to retain the security barrier, a weather strip channel to retain the weather strip and an insect screen channel, partially formed by the security barrier to retain the insect screen. An optional clip retaining channel is used to increase the window guard insert's ability to withstand an unauthorized entry attempt.

In a first embodiment, the security barrier comprises a perforated metal panel.

In a second embodiment, the security barrier comprises a sheet of wire cloth.

The present invention also includes the frame for retaining the insect screen and security barrier, the method of fabricating the window guard insert, and the method of retaining the window guard insert within a conventional screen window——storm window retaining track.

One advantage of the present invention is that it provides an easily removable assembly of the above type which includes a security barrier formed of a combination of a high-strength metal capable of withstanding the forces of an intruder and a fine screen mesh serving to prevent unwanted insect penetration.

Another advantage of the present invention is that it provides an assembly of the above type which is durable, yet has a relatively inconspicuous appearance.

Yet another advantage is that it blocks out a substantial percentage of the sun's harmful ultra-violet rays while maintaining adequate air flow when the window is open to ventilate the interior of the building.

Yet another advantage of the present invention is that it presents an attractive appearance and affords a high degree of security and insect protection, yet can be manufactured and installed at relative low cost.

Still another advantage is that a removably mounted window guard expedites fast and sure egress in a dark, smoke-filled room or under other emergency conditions.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

Figure 1:
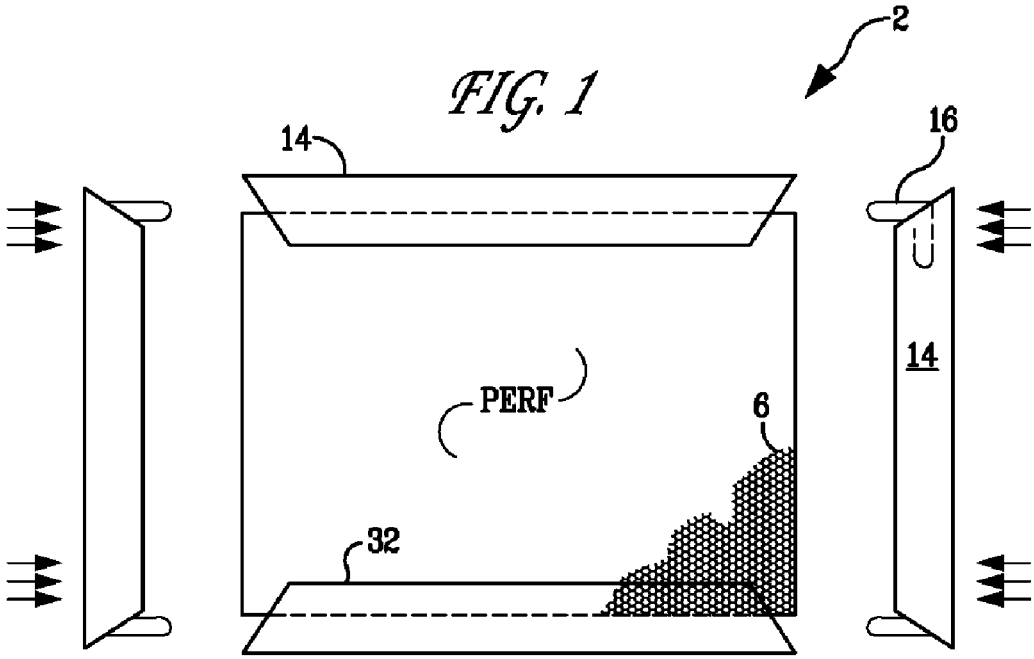
FIG. 1 is an exploded top view of the window guard insert.

The combination security and insect guard insert of the present invention will be described with reference to a window opening. However, the present invention may be adapted to fit any structural opening containing a frame capable of interchanging known screen or storm coverings, for example, a window opening capable of interchanging a screen or storm window or a door opening capable of interchanging a screen or storm door.

For purposes of this description, the following terms have the following meaning:

Definition List 1

| Term | Definition |
|---|---|
| Inward | a direction towards the center point of the window guard insert |
| Outward | a direction away from the window |
| Interior | a direction towards the window |
| Exterior | a direction away from the window |
| Innermost | a direction towards the center point of the window guard insert |

Turning now to the figures, and in particular, to FIGS. 1 through 4, the major structural components of window guard insert 2 comprise frame 4, security barrier 6, insect screen 8, spline 10, and weather strip 12.

Frame 4 is preferably fabricated from a substantially rigid, preferably lightweight, high-strength and corrosion-resistant material, for example, metal such as die cast, extruded, or rolled aluminum, aluminum alloy and stainless steel; molded plastic; laminate plastic and combinations thereof. In a preferred embodiment, frame 4 is comprised of a plurality of segments 14 fixedly joined to one another. Any known method of joining may be utilized, for example, welding, or corner lock blocks (not shown). To reduce manufacturing costs and improve esthetics, in the preferred embodiment frame segments 14 have mitered ends, joined with corner key 16.

Figure 6:
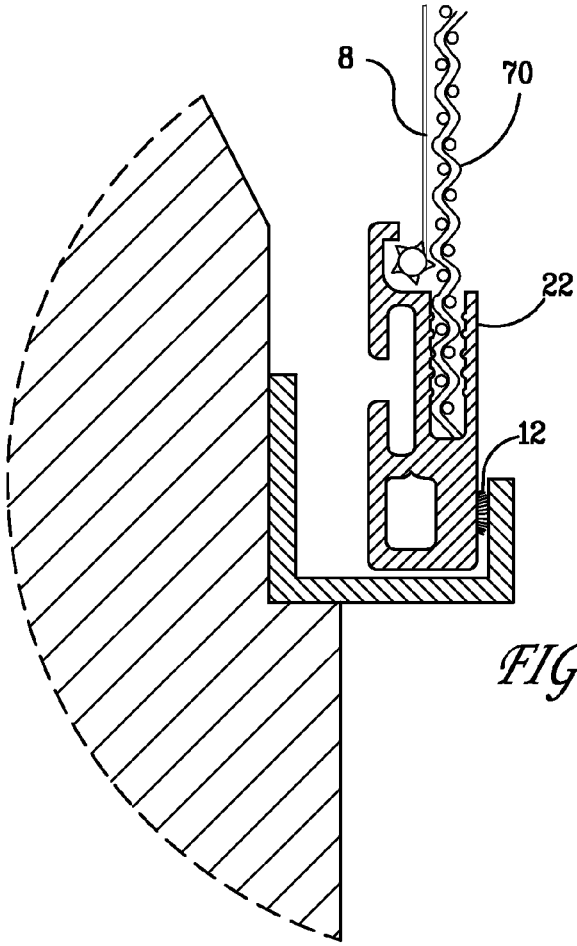
FIG. 6 is a cross sectional view of the window guard insert within circle 2 of FIG. 3 utilizing woven wire cloth and a weather strip adhered to the frame exterior wall.

Weather strip 12 may be adhered, for example, glued, to frame exterior wall 22 (FIG. 6). However, in the preferred embodiments, weather strip 12 is wool pile retentively held within weather strip channel 26 fabricated in frame exterior wall 22 at a location that insures weather strip 12 contacts interior surface of track exterior wall 24 when frame 4 is fully seated within track 18. Weather strip channel 12 retentiveness is due, for example, to two channel opening projections 28.

Weather strip 12 may be adhered, for example, glued, to frame exterior wall 22. However, in the preferred embodiments, weather strip 12 is wool pile retentively held within weather strip channel 26 fabricated in frame exterior wall 22 at a location that insures weather strip 12 contacts interior surface of track exterior wall 24 when frame 4 is fully seated within track 18. Weather strip channel 12 retentiveness is due, for example, to two channel opening projections 28.

Security barrier channel 30 opens into frame inward side 32 and is effectively sized to intimately receive security barrier 6. A plurality of optional scallops 34 help to keep seated security barrier 6 from sliding within security barrier channel 30. Innermost portion of frame interior wall 36 terminates in an outwardly facing projection 38 used to retain spline 10.

Figure 2:
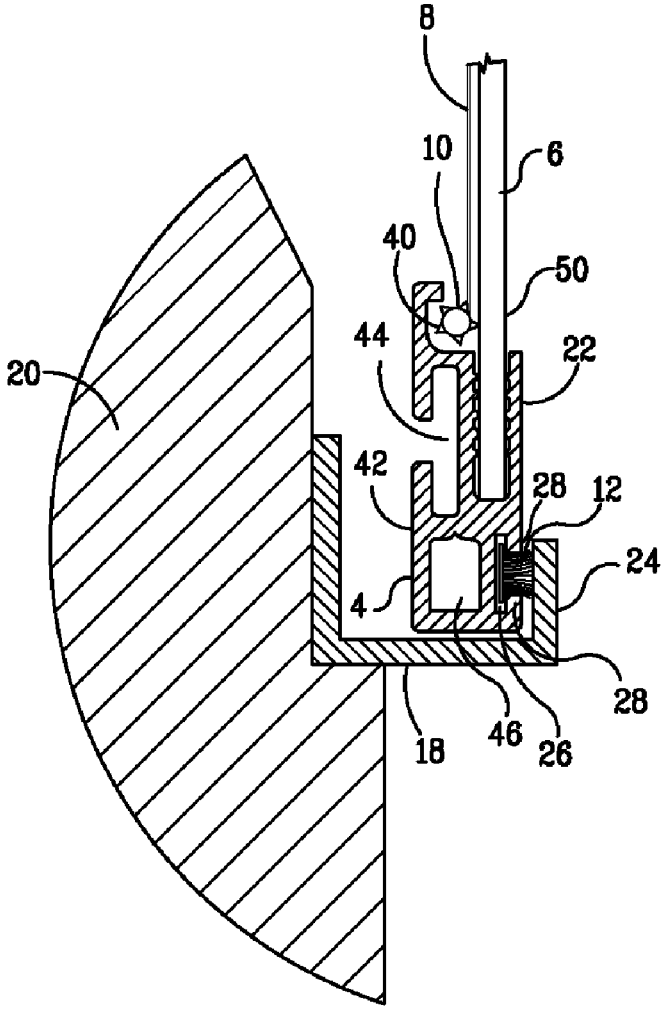
FIG. 2 is a cross sectional view of the window guard insert within circle 2 of FIG. 3 utilizing a perforated barrier.
Figure 3:
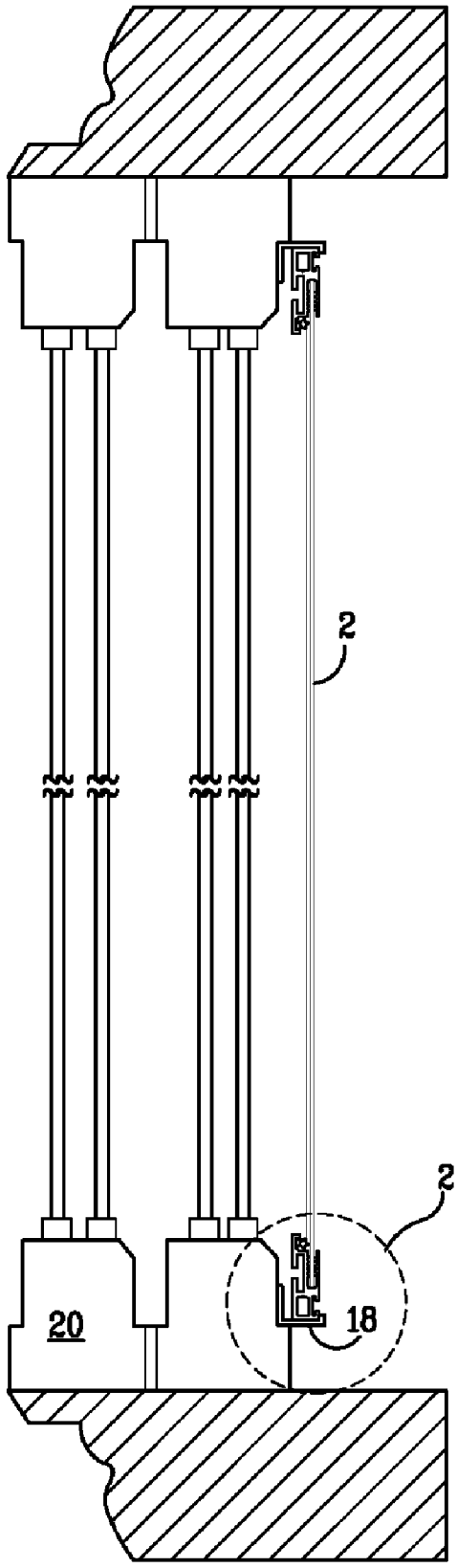
FIG. 3 is a cross-sectional view of the installed window guard insert.
Figure 4:
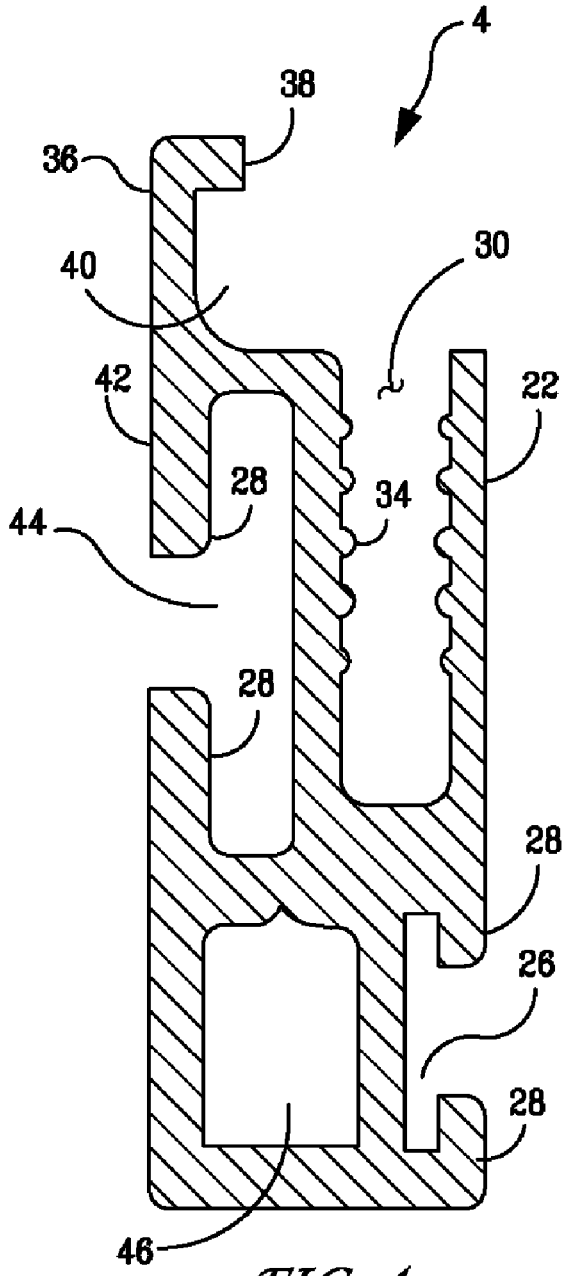
FIG. 4 is a cross sectional view of a frame section.
Figure 5:
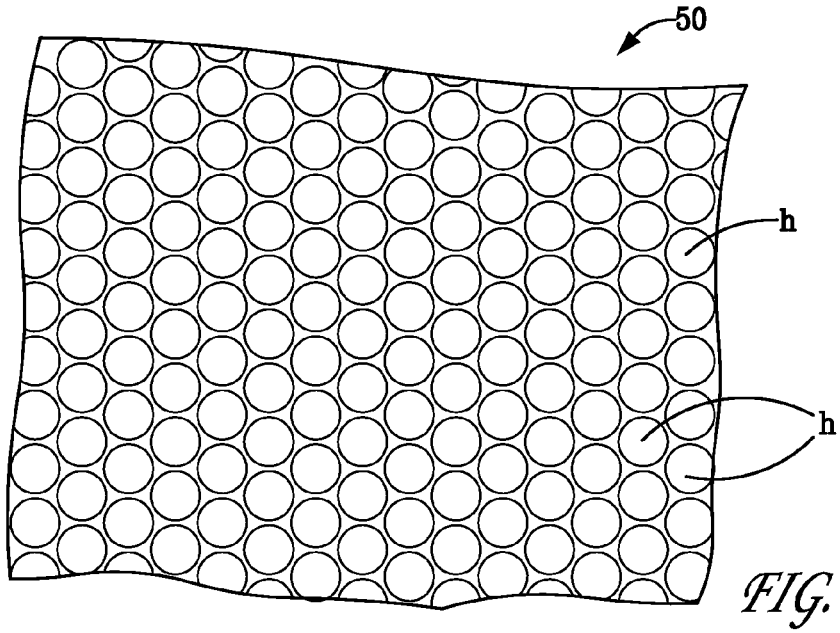
FIG. 5 is a top view of a portion of a perforated barrier.

In a first preferred embodiment, illustrated in FIG. 2, security barrier 6 is, for example, a perforated metal panel 50 having circular holes h, as shown separately in FIG. 5. The holes are in a rectangular array pattern in which each horizontal row of holes is staggered 60 degrees with respect to the adjacent row of holes. Hence, the arcuate metal lands in the network interconnecting the array of holes are thin so that the perforated barrier only serves to somewhat reduce the passage of light and the flow of air through the barrier toward the protected window.

Nevertheless, the barrier acts to shutter out a substantial portion of the sun's harmful ultra-violet rays while maintaining proper air flow and light transmission. The uniform pattern of circular holes h in the perforated barrier effectively exposes the covered window in the manner of a scrim curtain. This scrim reduces the illumination of the curtained window without visually blocking the window. Thus, when the perforated barrier is in place, a person looking toward the window is scarcely aware of the barrier, hence, the barrier panel is relatively inconspicuous.

In order for security barrier 6 to function effectively as a security shield, it is essential that it have adequate strength capable of withstanding attempted forced entry. To this end, perforated metal panel 50 may be made of, for example, perforated heavy-duty galvannealed steel or stainless steel. To render perforated metal panel 50 weather resistant, it may be, for example, coated with a polyester film. Additionally, a liquid coating may be baked on the panel to enhance its attractiveness. Such perforated metal panels are available from Diamond Manufacturing of Exeter, Pa.

Figure 7:
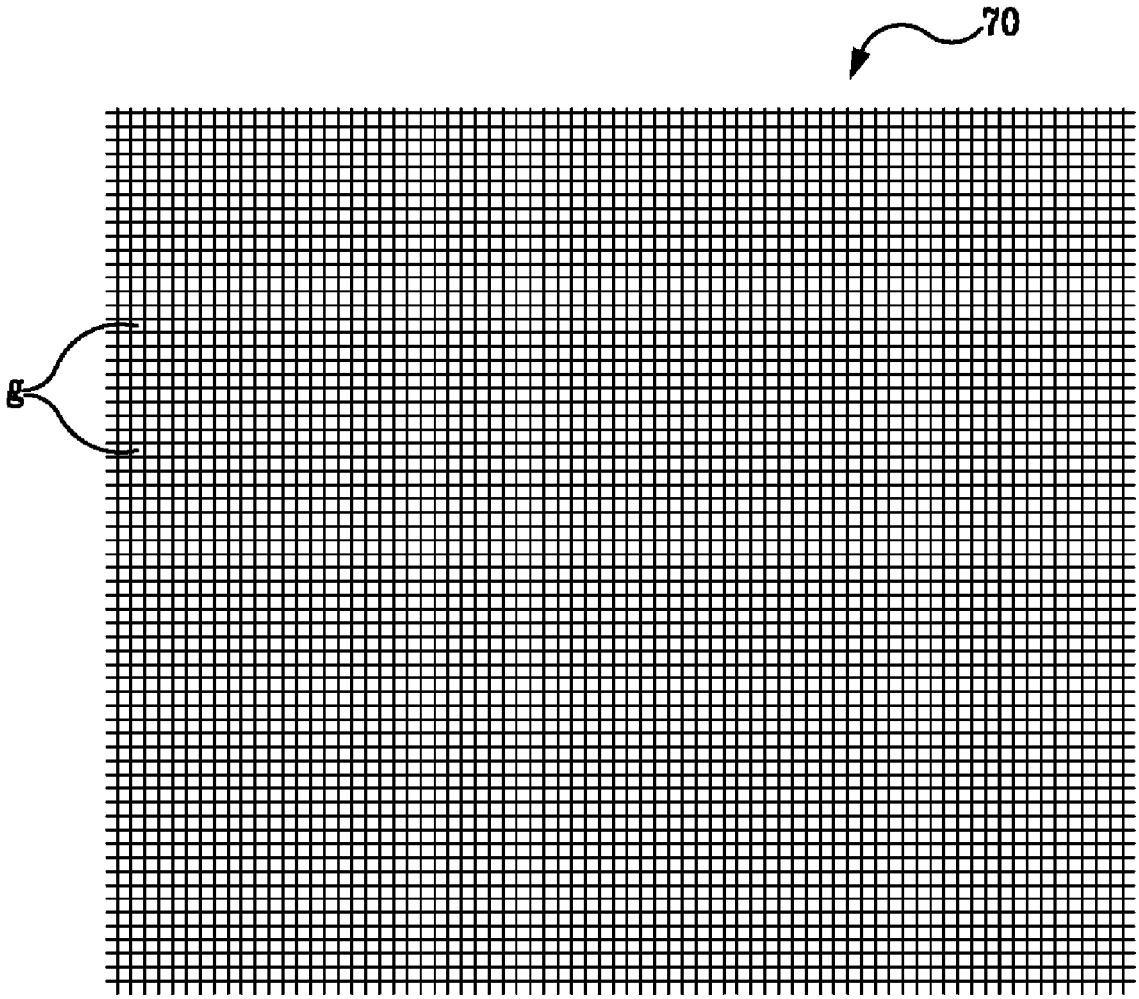
FIG. 7 is a top view of a portion of woven wire cloth.

In a second preferred embodiment, illustrated in FIG. 6, security barrier 6 is, for example, conventional wire cloth 70 as shown separately in FIG. 7. Wire cloth 70 is manufactured to provide effective resistance to unwanted forced entry while simultaneously providing effective visibility, air flow and esthetics.

Wire cloth is, for example, stainless steel woven wire mesh cloth utilizing 304 stainless steel having about 12×12 mesh×about 0.028" wire diameter, with a weight of about 0.64# per square foot. Each grid opening g is about a 0.055" opening which equates to a total open area of about 43.6%, hence, the woven wire mesh cloth only serves to somewhat reduce the passage of light and the flow of air through the barrier toward the protected window.

Insect screen 8, for example, a conventional fine mesh insect screen, serves to prohibit insect penetration. Innermost portion of frame interior wall 36 in conjunction with seated security barrier 6 forms insect screen channel 40. Alternatively, insect screen channel 40 may be described as located inward of the security barrier channel 30, formed by frame interior wall 36 and spline retaining outwardly facing projection 38 located at an innermost portion of frame interior wall 36, the projection 38 being interiorly offset from the security barrier channel 30. Insect screen 8 is inserted into insect screen channel 40 and retained with spline 10. Spline may be, for example, a rigid strip of metal or plastic, or a flexible strip of rubber or plastic, or combinations thereof, and once inserted is retained by frame interior wall outwardly facing projection 38.

A plurality of conventional screen window—storm window clips (not shown) are used to install window guard insert 2 in the same manner a conventional screen window— storm window is installed. Clips (not shown) are accessed from within the building and exert an outward force on frame interior wall 42, thereby wedging window guard unit 2 between clips (not shown) and track exterior wall 24. Weather strip 12 fills in any irregularities in interior surface of track exterior wall 24.

For increased security, in the preferred embodiments, optional clip retaining channel 44 is used to increase window guard insert 2 retentiveness. Optional clip retaining channel 44 is fabricated in frame interior wall 36, effectively positioned to receive a plurality of conventional screen window—storm window clips (not shown). The additional clip retentiveness is due to at least one channel opening projections 28.

Corner key receiving channel 46 is, for example, a rectangular shaped channel positioned to receive one end of corner key 16. In the preferred embodiment, corner key receiving channel 46 is positioned interior of weather strip channel 26. Corner key 16 is a conventional corner key adapted to snugly and frictionally and interlockingly project within corner key receiving channel 46.

Window guard insert 2 is assembled by cutting mitered segments 14 of predetermined length such that once assembled, frame 4 is of a predetermined shape to be effectively retained by a plurality of conventional screen window—storm window clips (not shown) within a preselected conventional structural opening retaining track, for example, a screen window—storm window retaining track 18. Security barrier 6 is cut to a preselected shape to effectively fit within assembled frame 4.

Security barrier 6 is slid within each frame security barrier channel 30 to engage scallops 34. As mitered ends of frame 4 approach one another, corner key 16 is inserted into corner key receiving channels 46 to lock frames 4 together, thereby retentively encasing security barrier 6. Insect screen 8 is conventionally cut to overlap frame interior wall 36 a predetermined amount such than when spline 10 overlays insect screen 8 and is thereafter pushed into insect screen channel 40, insect screen 8 is retained by spline 10 without showing any excess insect screen 8. Weather strip 12 is thereafter inserted into weather strip channel 26.

Because insect screen 8 is positioned between security barrier 6 and window 20, it is better protected from the outside elements. However, insect screen 8 remains the component most likely to become damaged during use. It should be apparent that the window guard insert 2 of the present invention allows for easy replacement of insect screen 8 should it become damaged.

Window guard insert 2 is thereafter placed within a conventional screen window—storm window retaining track 18 and retained using a plurality of conventional screen window—storm window clips (not shown) which optionally engage optional clip retaining channel 44.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A removable combination security and insect guard insert comprising:

a weather strip affixed to a frame exterior wall at a location that insures the weather strip contacts an interior surface of a window track exterior wall when the frame is fully seated within a window track;

a security barrier channel extending into a frame inward side;

a security barrier intimately received by the security barrier channel;

an insect screen channel located inward of the security barrier channel formed by a frame interior wall and the security barrier;

a spline retaining outwardly facing projection located at an innermost portion of a frame interior wall;

an insect screen retained within the insect screen channel; and a spline for retaining the insect screen within the insect screen channel.

2. The removable combination security and insect guard insert of claim 1 wherein the weather strip is adhered to the frame exterior wall.

3. The removable combination security and insect guard insert of claim 1 further comprising a weather strip channel in the frame exterior wall effectively shaped to retentively engage the weather strip.

4. The removable combination security and insect guard insert of claim 3 wherein the weather strip channel includes two channel opening projections positioned to retentively engage the weather strip.

5. The removable combination security and insect guard insert of claim 1 wherein the security barrier channel includes a plurality of scallops.

6. The removable combination security and insect guard insert of claim 1 further comprising a clip retaining channel fabricated in an interior side of the frame interior wall, effectively positioned for retentively receiving a plurality of window clips.

7. The removable combination security and insect guard insert of claim 6 wherein the clip retaining channel includes at least one channel opening projection located to retentively engage the plurality of window clips.

8. The removable combination security and insect guard insert of claim 1 wherein a plurality of frame segments are joined to form the frame assembly.

9. The removable combination security and insect guard insert of claim 8 wherein the frame segments are joined by a plurality of corner keys adapted to snugly and frictionally and interlockingly project into a frame segment corner key receiving channel.

10. The removable combination security and insect guard insert of claim 1 wherein the security barrier is a perforated metal panel.

11. The removable combination security and insect guard insert of claim 10 wherein the perforated metal panel comprises a plurality of circular holes in a rectangular array pattern in which a horizontal row of holes is staggered about 60 degrees with respect to an adjacent row of holes.

12. The removable combination security and insect guard insert of claim 1 wherein the security barrier is wire cloth.

13. The removable combination security and insect guard insert of claim 12 wherein the wire cloth comprises a plurality of grid openings of about 0.055".

14. The removable combination security and insect guard insert of claim 1 wherein the insect screen is a fine mesh screen.

15. The removable combination security and insect guard insert of claim 1 wherein the spline is a material selected from the group consisting of rigid metal strip, rigid plastic strip, flexible rubber strip, flexible plastic strip, and combinations thereof.

16. A method of forming a removable combination security and insect guard insert comprising the steps consisting of:

cutting a plurality of the frame segments wherein the frame segments comprise a security barrier channel extending into a frame inward side, effectively sized to intimately receive a security barrier and an insect screen channel located inward of the security barrier channel formed in part by a frame interior wall and a spline retaining outwardly facing projection located at an innermost portion of the frame interior wall;

cutting an effectively sized security barrier to fit within the assembled frame segments;

cutting an effectively sized insect screen to fit within the assembled frame segments;

assembling the frame segments into a frame assembly such that the effectively sized security barrier is retentively encased within an assembled security barrier channel;

inserting the insect screen into an assembled insect screen channel formed by the frame interior wall, the projection and the security barrier;

retentively engaging the insect screen by inserting the spline into the assembled insect screen channel; and affixing the weather strip to the assembled frame segments.

17. The method of claim 16 further comprising the step of retentively inserting the assembled removable combination security and insect guard into a structural opening retaining track.

18. The method of claim 17 wherein the assembled removable combination security and insect guard insert is retentively inserted using a plurality of clips to engage a clip retaining channel fabricated in an interior side of the frame interior wall.

19. The removable combination security and insect guard insert of claim 1 wherein the insect screen channel is formed by the frame interior wall and the spline retaining outwardly facing projection located at an innermost portion of the frame interior wall.

* * * * *